US006886973B2

(12) United States Patent
Phillips

(10) Patent No.: US 6,886,973 B2
(45) Date of Patent: May 3, 2005

(54) GAS STREAM VORTEX MIXING SYSTEM

(75) Inventor: Barry L. Phillips, Rockdale, TX (US)

(73) Assignee: Basic Resources, Inc., Dallas, TX (US)

( * ) Notice: Subject to any disclaimer, the term of this patent is extended or adjusted under 35 U.S.C. 154(b) by 0 days.

(21) Appl. No.: 09/753,944

(22) Filed: Jan. 3, 2001

(65) Prior Publication Data

US 2002/0085448 A1 Jul. 4, 2002

(51) Int. Cl.[7] ..... B01F 5/04

(52) U.S. Cl. ..... 366/181.5; 366/174.1; 60/301

(58) Field of Search ..... 366/174.1, 181.5, 366/336, 337, 340, 173.1, 173.2, 338; 48/189.4; 138/37, 39; 60/301, 324

(56) References Cited

U.S. PATENT DOCUMENTS 3,671,208 A * 6/1972 Medsker
3,930,370 A 1/1976 Markowski et al.
3,957,418 A 5/1976 Sata
3,974,646 A 8/1976 Markowski et al.
4,026,527 A * 5/1977 Costen
4,079,718 A * 3/1978 Holzbaur
4,099,268 A * 7/1978 Luthi
4,344,479 A 8/1982 Bailey
4,498,786 A * 2/1985 Ruscheweyh
4,560,304 A * 12/1985 Jenkins et al.
4,619,608 A 10/1986 McIntyre et al.
4,850,537 A 7/1989 Gourdine
4,899,772 A * 2/1990 Rao
4,929,088 A * 5/1990 Smith
4,981,368 A * 1/1991 Smith
5,181,475 A 1/1993 Breen et al.
5,236,354 A 8/1993 Goldbach et al.
5,456,533 A * 10/1995 Streiff et al.
5,456,596 A 10/1995 Gourdine
5,518,311 A * 5/1996 Althaus et al.
5,575,153 A 11/1996 Ito et al.
5,836,282 A 11/1998 Mallen
5,941,063 A * 8/1999 Wang et al.
5,979,395 A 11/1999 Mallent et al.
6,015,229 A * 1/2000 Cormack et al.
6,026,644 A 2/2000 Ito et al.
6,135,629 A * 10/2000 Dohmann

OTHER PUBLICATIONS

"Wing Vortices" U.S. Centennial of Flight Commision.*
Warhaft, Z. "Transition and Turbulence".*
Glossary from nas.nasa.gov.*
DB Riley Technical Publication entitled, "*Adapting the German Coal–Fired SCR Experience of the U.S.*", by Thomas F. Robinson and Paul E. Croteau, DB Riley Environmental Systems, Worcester, Massachusetts., presented at Power—Gen International '97, Dec. 9–11, 1997, Dallas, Texas.
Deutsche Babcock, DB Riley, Inc. publication entitled, "*Total Support for Power Generating Systems*", © 1996 DB Riley, Inc.
Deutsche Babcock, DB Riley, Inc. brochure entitled, "*Selective Catalytic Reduction*", © 1996 DB Riley, Inc.
Deutsche Babcock, DB Riley, Inc. 4 page paper entitled, "*SCR Overview*", dated Feb., 1998.

* cited by examiner

*Primary Examiner*—David L. Sorkin
(74) *Attorney, Agent, or Firm*—Hunton & Williams LLP

(57) ABSTRACT

A gas stream vortex mixing system for mixing gas is provided. The gas stream vortex mixing system includes a duct provided with an outer surface defining an interior passageway operable for communicating a gas. The gas stream vortex mixing system further includes at least one nozzle and at least one wing. The wing is disposed within the interior passageway of the duct and is operable for generating at least one vortex. The nozzle is disposed within the interior passageway of the duct. The nozzle is operable to discharge a mixture into the interior passageway of the duct.

1 Claim, 4 Drawing Sheets

GAS STREAM VORTEX MIXING SYSTEM

TECHNICAL FIELD OF THE INVENTION

This invention relates in general to the field of gas mixing and more particularly, but not by way of limitation, to a gas stream vortex mixing system and method for mixing power plant combustion exhaust gas.

BACKGROUND OF THE INVENTION

The electric utility industry strives to efficiently provide electric power while minimizing the impact that electrical generation has on the environment. One specific point of concern is reducing harmful exhaust gas emissions from power plants.

Power plants produce dangerous combustion gases, such as NOx (oxides of nitrogen like NO and NO2), which are exhausted as a by-product of electric generation. The combustion or flue gases are carried by large ducts or flues through treatment systems intended to reduce the NOx emissions. One commonly employed treatment process, called selective catalytic reduction (SRC), reduces NOx emissions by injecting an ammonia mixture into the combustion gases and passing the combined constituent gas, combustion gas mixed with the ammonia mixture, over a catalyst. The catalyst reacts with the harmful gas changing it into harmless gas comprised of nitrogen related compounds, thus reducing or eliminating the NOx emissions.

When the combustion gases are uniformly mixed with the ammonia mixture and passed over the catalyst within a specific temperature range, the catalyst is highly effective at reducing NOx emissions. However, a uniform constituent gas mixture is difficult to achieve given the volume of combustion gas which must be uniformly mixed within the large ducts. These ducts range in shape, such as rectangular and oval, and size, but often have passageways of 20 feet by 40 feet or more.

Frequently, the constituent gas flowing within the ducts develops small channels containing high concentrations of the various flue gas constituents (CO, CO2, NOx, for example) and the injected ammonia, or rope flows, while the constituent gas throughout the remaining duct cross section will contain low concentrations of NOx making proper mixing with ammonia prior to the SCR most difficult. When such inhomogeneous constituent gas is passed through the catalyst, the rope flow zones exit the catalyst with high levels of flue gas constituents and/or ammonia that were not reacted by the catalyst due to the improper mixing of flue gas and ammonia. The remaining combustion gas with low concentrations of NOx will be catalyzed by the SCR, but the ammonia will be under utilized and emitted into the atmosphere at greater than acceptable concentration.

The remedy has generally been to inject more ammonia mixture into the combustion gas in the ducts to reduce the NOx emissions. While this does lower NOx, increasing the ammonia concentration is costly, inefficient, and results in increased ammonia emissions.

Another approach has been to place obstacles into the ducts to disrupt the flow of combustion gas in order to achieve an improved mixture of constituent gases. However, such obstacles create only turbulent flow of the combustion gases and provide only minimum improvement of the mixture of constituent gases. Additionally, the turbulence inducers generate resistance in the ducts which reduces the efficiency of the flow of combustion gases through the ducts and increases the load on the fan systems that move the combustion gases through the ducts.

Thus, a need exists for an improved system and method for mixing the stream of combustion gases and injected ammonia mixture into a uniform mixture of constituent gases. It is to such a gas stream mixing system and method that the present invention is directed.

SUMMARY OF THE INVENTION

The present invention provides a gas stream vortex mixing system for mixing gas. The gas stream vortex mixing system includes a duct provided with an outer surface defining an interior passageway operable for communicating a gas. The gas stream vortex mixing system further includes at least one nozzle and at least one wing. The wing is disposed within the interior passageway of the duct and is operable for generating at least one vortex. The nozzle is disposed within the interior passageway of the duct. The nozzle is operable to discharge a mixture into the interior passageway of the duct.

In another embodiment, a gas stream vortex mixing system for mixing combustion gas exhaust is provided. The gas stream vortex mixing system includes a duct provided with an outer surface defining an interior passageway operable for communicating a combustion gas. The gas stream vortex mixing system further includes at least one wing disposed within the interior passageway. The wing is operable for generating a vortex The gas stream vortex mixing system also includes at least one nozzle disposed adjacent at least one wing within the interior passageway of the duct. The nozzle is operable to discharge a mixture into the vortex generated by the wing.

In yet another embodiment, the present invention provides for a method of mixing gas by creating a predictable and ordered vorticity. The method includes providing a gas stream vortex mixing system. The gas stream vortex mixing system includes a duct provided with an outer surface defining an interior passageway operable for communicating a gas.

The gas stream vortex mixing system further includes at least one nozzle and at least one wing. The wing is disposed within the interior passageway of the duct and is operable for generating at least one vortex. The nozzle is disposed within the interior passageway of the duct. The nozzle is operable to discharge a mixture into the interior passageway of the duct.

The method includes providing a supply of combustion gas into the interior passageway of the duct such that the combustion gas passes about at least one of the wings of the gas stream vortex mixing system generating a vortex. The method further includes discharging the mixture from at least one nozzle into the vortex such that the mixture is homogenized with the combustion gas within the vortex.

In another embodiment, the present invention provides a method of mixing gas by creating a predictable and ordered vorticity. The method includes providing a gas stream vortex mixing system having a duct provided with an outer surface defining an interior passageway operable for communicating a combustion gas. The gas stream vortex mixing system is further provided with at least one wing having an asymmetrical airfoil shape with a defined camber line such that the wing is operable to more efficiently generate lift, resulting in stronger vorticity at lower gas flow resistance.

In yet another embodiment, the present invention provides for a more simple way to achieve most of the positive effects by shaping the wing from a flat plate and forming the desired camber line into the plate along the span of the wing.

The wing is positioned within the interior passageway of the duct such that the chord line of the airfoil is substantially parallel to a line defining the direction of the flow of combustion gas within the interior passageway of the duct. The wing is operable for generating at least one vortex at one or more points on the wing. The gas stream vortex mixing system further includes at least one nozzle disposed adjacent the wing within the interior passageway of the duct. The nozzle is operable to discharge a mixture into the vortex generated by the wing.

The method includes providing a supply of combustion gas into the interior passageway of the duct such that the combustion gas passes near at least one of the wings of the gas stream vortex mixing system thereby generating a vortex. The method further includes discharging the mixture from at least one nozzle into the vortex such that the mixture is homogenized with the combustion gas within the vortex.

Other technical advantages are readily apparent to one skilled in the art from the following figures, description, and claims.

BRIEF DESCRIPTION OF THE DRAWINGS

For a more complete understanding of the present invention and the advantages thereof, reference is now made to the following brief description, taken in connection with the accompanying drawings and detailed description, wherein like reference numerals represent like parts, in which.

DETAILED DESCRIPTION OF THE INVENTION

It should be understood at the outset that although an exemplary implementation of the present invention is illustrated below, the present invention may be implemented using any number of techniques, whether currently known or in existence. The present invention should in no way be limited to the exemplary implementations, drawings, and techniques illustrated below, including the exemplary design and implementation illustrated and described herein.

Figure 1:
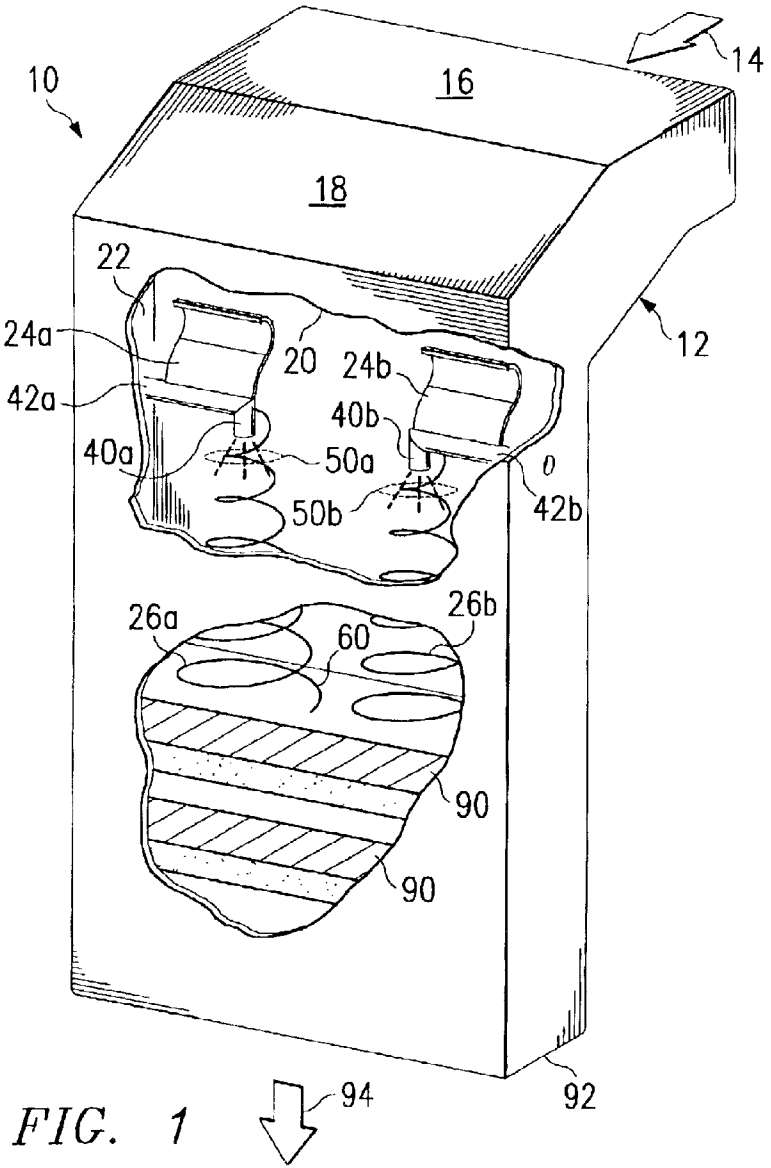
FIG. 1 is a side elevational view of a gas stream vortex mixing system according to an embodiment of the invention employing catalyst modules

FIG. 1 is a side elevational view of a gas stream vortex mixing system 10 constructed in accordance with the present invention. The gas stream vortex mixing system 10 includes a duct 12, also commonly referred to as a flue, which is in communication with the combustion chamber of an electric power plant (not shown).

The duct 12 may be constructed from a variety materials, such as sheet metal, is sized to receive a combustion gas 14 from the power plant combustion chamber (not shown). The manufacture and use of ducts 12 to communicate and direct the flow of combustion gases 14 is well known in the art therefore no further discussion is deemed necessary to teach one of ordinary skill in the art in the use of ducts 12.

The combustion gas 14 includes the exhaust gases produced as a by-product of the electric generation process. The duct 12 receives the combustion gas 14 into one end 16 thereof the duct 12. The duct 12 is provided with an outer surface 18 and an inner surface 20, the outer surface 18 and inner surface 20 defining an interior passageway 22 operable for communicating the combustion gas 14.

The gas stream vortex mixing system 10 further includes at least one wing 24. Although the wings 24 are substantially similar in construction and design, the wings 24 have been denoted alphanumerically for purposes of clarity wings 24*a* and 24*b*. The wings 24*a* and 24*b* will be discussed in greater detail hereinafter. The wings 24*a* and 24*b* are disposed within the interior passageway 22 of the duct 12.

The wings 24*a* and 24*b* may be constructed from a variety of materials, such as, but not limited to sheet metal or rigid polymeric materials, for example. The wings 24*a* and 24*b* may be attached to the inner surface 20 of the duct 12 in various ways including, but not limited to using a standard nut and bolt assembly, welding, or by other means which will readily suggest themselves to one of ordinary skill in the art.

The wings 24*a* and 24*b* are substantially configured having the attributes of airfoils and are operable for generating at least one vortex 26. The vortices 26*a* and 26*b* have been denoted alphanumerically for purposes of clarity. It is readily apparent that as the combustion gas 14 is communicated through the interior passageway 22 of the duct 12 and caused to pass about the wings 24*a* and 24*b*, the vortices 26*a* and 26*b* will be shed from the wings 24*a* and 24*b* respectively. The characteristics of the vortices 26*a* and 26*b* shed from wings 24*a* and 24*b* will be discussed in greater detail hereinafter.

The gas stream vortex mixing system 10 also includes at least one nozzle 40. The nozzles 40 are constructed substantially similar and have been denoted alphanumerically 40*a* and 40*b* for purposes of clarity. The nozzles 40*a* and 40*b* are connected to a supply line 42*a* and 42*b*, respectively, of a desired mixture, such as, but not limited to, ammonia or other chemical compounds beneficially injected into the combustion gas 14.

The nozzles 40*a* and 40*b* are disposed within the interior passageway 22 of the duct 12, and operable to inject, for example, an ammonia mixture 50, or other mixture of a desired chemical compound, into the combustion gas 14 carried in interior passageway 22 of the duct 12. One advantage of the gas stream vortex mixing system 10 of the present invention, is the delivery of the ammonia mixture 50*a* and 50*b* into an intense vortex 26*a* and 26*b* to create a well mixed constituent gas 60 comprising combustion gas 14 and the ammonia mixture 50.

It will be appreciated that the wings 24*a* and 24*b* are designed having certain airfoil characteristics to shed vortices 26*a* and 26*b* having desired attributes, such as the direction of circulation, velocity, intensity, and expansion. In this manner, the vortex 26*a* may be caused to collide with vortex 26*b* for the purpose of further generating a homogenous mixture of constituent gases. Additionally, the vortex 26*a* and 26*b* may be calculated so as to encompass and include the maximum amount of combustion gas 14 for mixing with the ammonia mixture 50 to eliminate rope flow containing high concentrations of the certain of the flue gas constituents, for example, CO, CO2, NOx.

Once the constituent gas 60 is well mixed by the vortices 26*a* and 26*b* with the ammonia mixture 50 it is passed over one or more catalyst modules 90. The catalyst modules 90 are operable to catalytically reduce the NOx in the constituent gas 60 by reacting with the constituent gas 60 as it is passed over the catalyst modules 90. The reduced NOx emission gas 94 is then output from another end 92 of the duct 12. Thus, it can be appreciated that the gas stream vortex mixing system 10 of the present invention achieves the benefits of reduced emissions of NOx, more efficient use of the ammonia mixture 50, and longer life of the catalyst modules 90, due to the even distribution of constituent gas 60.

Figure 2:
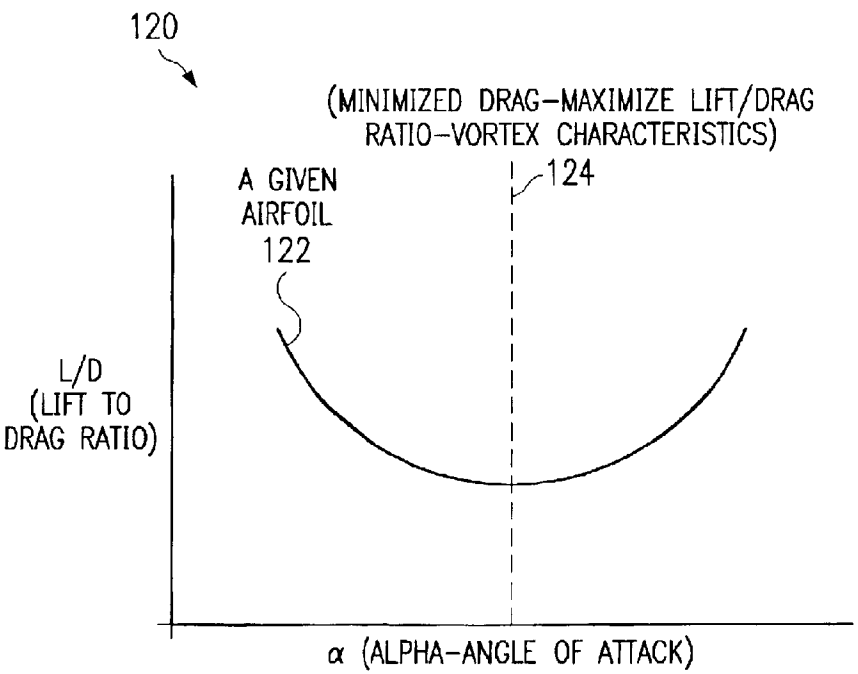
FIG. 2 is a graph detailing a lift to drag ratio at an angle of attack of a given airfoil.

FIG. 2 is a graph 120 detailing a lift to drag ratio at an angle of attack of a given airfoil 122. It is appreciated that when designing an airfoil to implement for the gas stream vortex mixing system 10, consideration should be given to defining the desired characteristics of the airfoil to be employed. As such, the optimum design provides for an airfoil having a maximized lift to drag ratio with a minimized drag 124 at a given angle of attack. The lift of a given airfoil 122 is relative to the energy of the vortex shed by the airfoil 122. That is, the higher the lift the stronger the vortex. The graph 120 provides for the design of the airfoil 122 which will provide a maximum lift and minimum drag and prevent turbulent or disrupted flow associated with a stall condition about the airfoil 122.

As previously mentioned, a stall condition has the effect of generating turbulent flow which generates unpredictable and unstable air flow about an obstacle in the duct 12. However, the turbulent flow is not desirous in that it provides on limited mixing of the combustion gas 14 with the ammonia mixture 50 and substantially impairs the even flow of combustion gas 14 through the duct 12. This uneven flow creates an inefficient state within the duct 12 which produces an increased load on fans which provide the combustion gas 14 to the duct 14 and drawing the constituent gas from the duct 12.

Thus, modeling provides opportunity to define an airfoil that generates a maximized lift to drag ratio while creating an optimized vortex. Furthermore, an airfoil 122 may produce a number of vortices along various point on the airfoil. Such an airfoil provides the gas stream vortex mixing system 10 with a predefined and ordered vorticity to generate a uniform and homogenous constituent gas 14. While the graph 120 is provided to illustrate modeling capabilities to derive suitable airfoils for the gas stream vortex mixing system 10, a variety of airfoils may be readily employed for such purposes.

Figure 3:
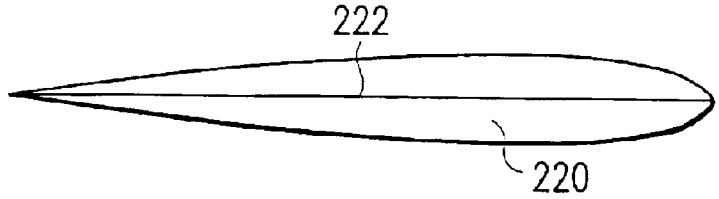
FIG. 3 is a side view of a symmetrical wing according to an embodiment of the present invention.

FIG. 3 is a side view of a symmetrical wing 220 according to an embodiment of the present invention. It is appreciated that when designing wings, such as the wings 24*a* and 24*b*, shown in FIG. 1, to provide a given characteristic, a variety of wing configurations may be employed. The symmetrical wing 220 is an embodiment of one such configuration which is readily adapted to achieve the advantages and provide the benefits disclosed herein with reference to the wing 26 of the gas stream vortex mixing system 10. The symmetrical wing 220 has a chord line 222 defining a straight line extending the length of the cross section of the symmetrical wing 220.

Figure 4:
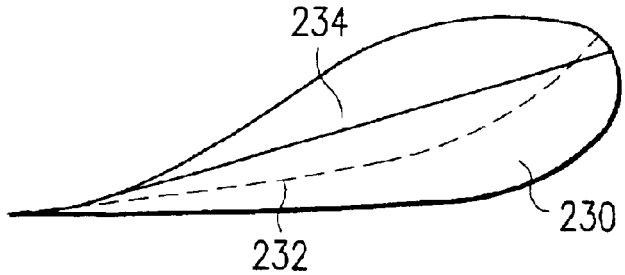
FIG. 4 is a side view of a cambered wing according to an embodiment of the present invention.

FIG. 4 is a side view of a cambered wing 230 having a camber line 232 according to an embodiment of the present invention which may be readily employed for the purposes of generating a vortex, such as the vortices 26*a* and 26*b* shown in FIG. 1. The cambered wing 230 is another embodiment of one such configuration which is readily adapted to achieve the advantages and provide the benefits disclosed herein with reference to the wing 26 of the gas stream vortex mixing system 10. The cambered wing 230, as with any wing or airfoil, has a chord line 234 defining a straight line extending the length of the cross section of the cambered wing 230.

Figure 5:
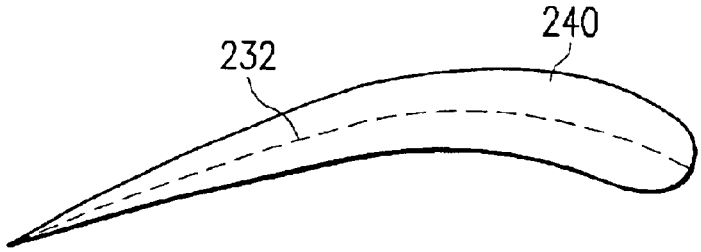
FIG. 5 is a side view of another embodiment of a wing constructed according to the present invention.

FIG. 5 is a side view of another embodiment of a wing 240 constructed according to the present invention similarly having the camber line 232. The wing 240 is another embodiment of one such configuration which is readily adapted to achieve the advantages and provide the benefits disclosed herein with reference to the wing 26 of the gas stream vortex mixing system 10.

Figure 6:
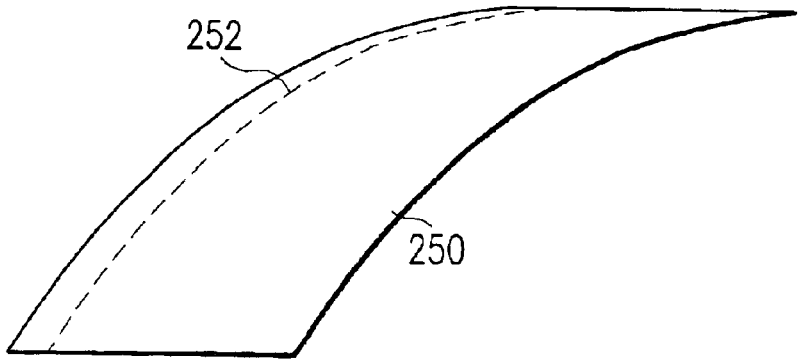
FIG. 6 is a perspective representation of a wing according to an embodiment of the present invention.

FIG. 6 is a perspective representation of a wing 250 according to an embodiment of the present invention. In this embodiment, the wing 250 constructed of a substantially rigid material, such as sheet metal. The wing 250 is angularly configured along a line 252 relative to the camber line 232 a wing, such as the wing 240 (see FIG. 10 or 230 (see FIG. 4), having the desired characteristics.

Because the wing 250 is substantially two-dimensionally constructed, the wing 250 will lack the complete characteristics of the wing, such as the wing 240 (see FIG. 10) or 230 (see FIG. 4). However, the wing 250 will achieve the general aerodynamic characteristics of the wing upon whose camber line 232 the wing 250 was modeled. In this embodiment, the wing 250 is a simple means for providing an optimized lift to drag ratio and a defined point (not shown) from which to shed the desired vortex without constructing the full airfoils shown above.

While several airfoil and wing configurations have been shown it should be appreciated that other configurations (not shown) of airfoils and wings operable to achieve the advantages and obtain the benefits described herein will readily suggest themselves to one of ordinary skill in the art and are within the spirit and scope of the present invention as disclosed and claimed herein. An additional consideration to the design of the wing, such as the wing 24*a* and 24*b* (see FIG. 1), is interaction and effect of other wings 24 within the same duct 12.

Figure 7:
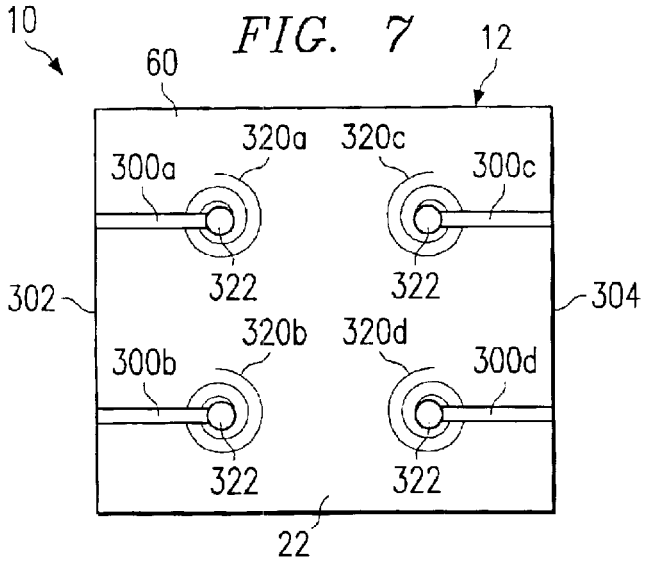
FIG. 7 is a top plan view of another embodiment of gas stream vortex mixing system of the present invention.

Referring now to FIG. 7, a top plan view of another embodiment of gas stream vortex mixing system 10 of the present invention is shown. In this embodiment, a plurality of wings 300 are denoted alphanumerically for purposes of clarity 300*a*, 300*b*, 300*c*, and 300*d*. The wings 300*a* and 300*b* are shown attached to one side 302 of the duct 12 while wing 300*c* and 300*b* are shown attached to an opposite side 304 of the duct 12.

In this manner, the vortices 320*a*, 320*b*, 320*c* and 320*d* generated by the wings 300*a*, 300*b*, 300*c* and 300*d*, respectively, create a predefined and ordered vorticity within the interior passageway 22 of the duct 12. The nozzles 322 are positioned near the point on the respective wing 300 where the vortex is shed. Such a configuration of the wings 300 and nozzles 322 is well adapted to provide a uniform and homogenous mixture of the constituent gases 60.

Figure 8:
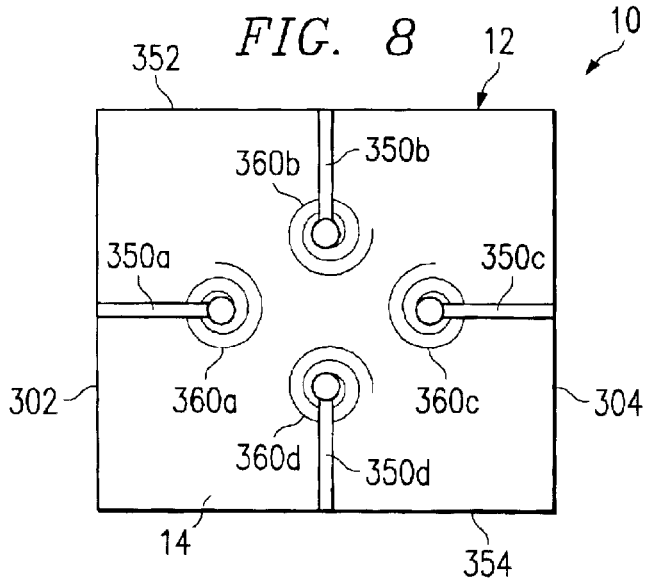
FIG. 8 is a top plan view of yet another embodiment of the gas stream vortex mixing system of the present invention.

Referring to FIG. 8, a top plan view of yet another embodiment of the gas stream vortex mixing system 10 of the present invention is shown. In this embodiment, a plurality of wings 350 are denoted alphanumerically for purposes of clarity 350*a*, 350*b*, 350*c*, and 350*d*. The wing 350*a* is shown attached to one side 302 of the duct 12 and the wing 350*b* is shown attached to an adjacent side 352 of the duct 12. The wing 350*c* is shown attached to the opposite side 304 of the duct 12 and wing 350*d* is shown attached to an adjacent side 354 of the duct 12.

It can be seen that vortices 360*a*, 360*b*, 360*c* and 360*d* rotate in a counter-clockwise direction due to the configuration of wings 350*a*, 350*b*, 350*c* and 350*d*, respectively. It may be beneficial to utilize wings 350 wherein the direction of rotation of the vortices, such as vortices 360*a*, 360*b*, 360*c* and 360*d*, is predetermined so as to further increase the uniformity of mixing of the combustion gases 14. In this manner, the vortices 360 can be caused to encompass the greatest possible amount of combustion gas 14 for optimum uniformity of constituent gas 60.

Figure 9:
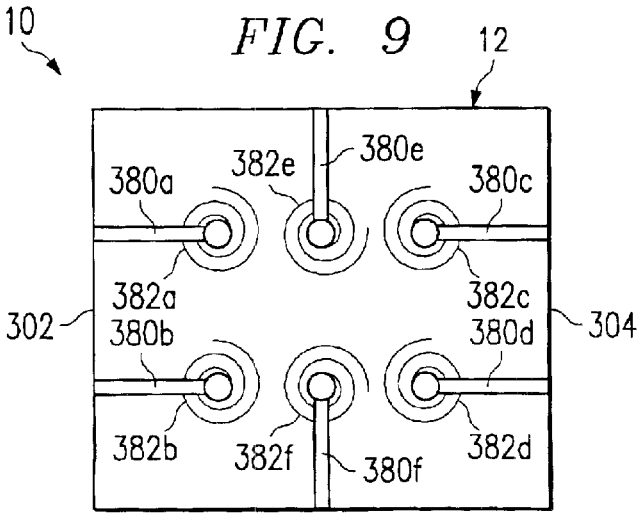
FIG. 9 is a top plan view of another embodiment of the gas stream vortex mixing system of the present invention showing another arrangement of the wings.

FIG. 9 shows a top plan view of another embodiment of the gas stream vortex mixing system 10 of the present invention. In this embodiment, a plurality of wings 380 are denoted alphanumerically for purposes of clarity 380*a*, 380*b*, 380*c*, 380*d*, 380*e* and 380*f*. The wings 380*a* and 380*b* are shown attached to one side 302 of the duct 12 while wing 380*c* and 380*b* are shown attached to an opposite side 304 of the duct 12. The addition of wings 380*e* and 380*f* to adjacent sides 352 and 354, respectively, of the duct 12 represent another configuration for optimizing the mixture of constituent gas 60. It is readily apparent that the plurality of wings 380 are disposed substantially about the same plane within the interior passageway 22 of the duct 12. It is apparent that the vortices 382*a* and 382*b* rotate clockwise while vortices 382*c*, 382*d*, 382*e*, and 382*f* rotate counter-clockwise to provide uniform distribution and homogeneity of the constituent gas 60.

While several embodiments are shown with various placements of wings, such as wing 300, 350, and 380, it will be appreciated that any number or combination of wings 300, 350, and 380 having varying characteristics to generate vortices 320, 360, and 382 are possible to generate the uniform distribution of constituent gas 60 within the inner passageway 22 of the duct 12 and remain within the spirit and scope of the invention disclosed herein.

Figure 10:
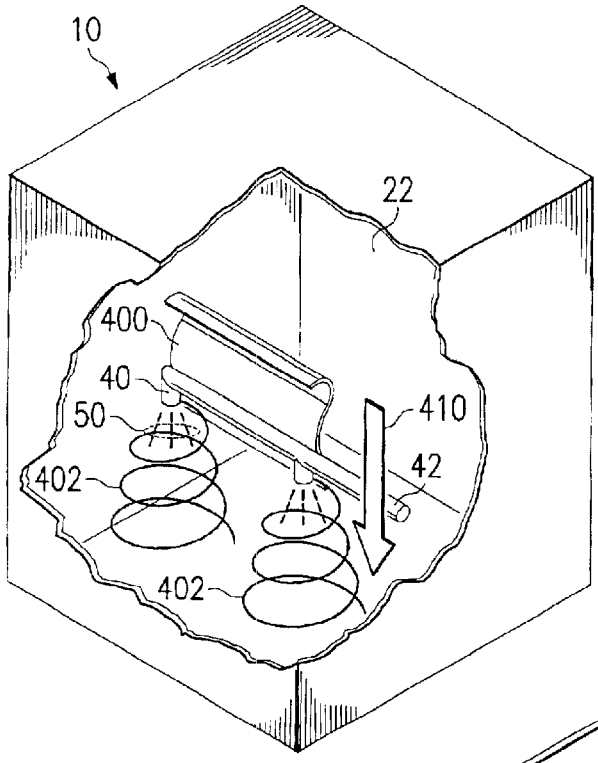
FIG. 10 is side elevational view another embodiment of the gas stream vortex mixing system of the present invention.

FIG. 10 shows another embodiment of the gas stream vortex mixing system 10 of the present invention employing a single wing 400 disposed within the center of the interior passageway 22 of the duct 12. In this embodiment, the wing 400 is suspended about the interior passageway 22. Such disposition of the wing 400 may be achieved, such as, but not limited to, attachment of the wing 400 to the supply line 42 providing the ammonia mixture 50.

In this manner, the wing 400 is operable to shed one vortex 402 from the tip of each wing 400. Additionally, whether the wing 400 is suspended within the interior passageway 22 of the duct 12 or attached to the inner surface 20 of the duct 12, it is readily apparent that the wing 400 is disposed such that the wing 400 generates lift and is disposed substantially parallel to direction 410 of the flow of combustion gas 14 through the duct 12. It can be seen that the wing 400 is positioned such that the chord line (not shown) is substantially parallel to the direction 410 of the flow of combustion gas 14. More specifically, the chord line of the wing 400 may be positioned at an angle of attack of from 5 to 15 degrees, and optimally from 8 to 12 degrees, relative to the direction 410 of the flow of combustion gas 14. In this manner, the ordered flow for mixing combustion gas may controlled to the maximum extent.

The nozzle 40 of the gas stream vortex mixing system 10 is shown disposed about a point on the wing 400 wherein the vortex 402 is shed. This placement of the nozzle 40 provides for optimum mixing of the ammonia mixture 50 with the combustion gas 14. Furthermore, while the nozzle 40 is shown injecting the ammonia mixture 40 in the direction 410 of the flow of combustion gas 14, it is appreciated that in another embodiment (not shown), the nozzle 40 may be reversed such that the ammonia mixture is injected in a direction opposite the direction 410 of the flow of combustion gas 14.

Figure 11:
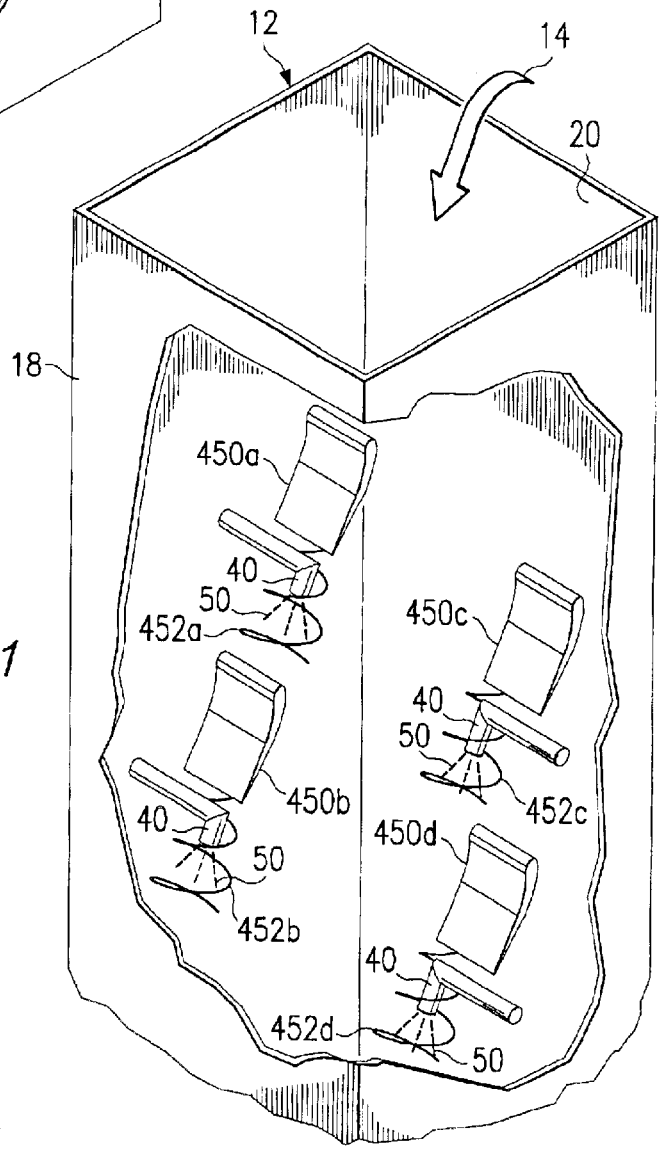
FIG. 11 is a side elevational view of yet another embodiment of the gas stream vortex mixing system of the present invention.

FIG. 11 is a side elevational view of yet another embodiment of the gas stream vortex mixing system 10 of the present invention. A plurality of wings 450, denoted 450*a*, 450*b*, 450*c*, and 450*d*, are attached to the inner surface 20 of the duct 12 along differing horizontal planes. The present embodiment describes yet another placement of wings within the interior passageway 22 to generate a predetermined and ordered vorticity to create a uniform mixture of constituent gas 60.

In the present embodiment, the nozzles 40 are placed substantially below the point on the wing where a vortex 452, denoted 452*a*, 452*b*, 452*c*, 452*d*, respectively, is shed. In this manner the vortex 452 has had substantial time to develop in diameter to allow for uniform mixing of the ammonia mixture 50 with the combustion gas 14.

In another embodiment, a method of mixing gas by creating a predictable and ordered vorticity is provided. The method includes providing the gas stream vortex mixing system 10 including the duct 12. The duct 12 is provided with an outer surface 18 defining an interior passageway 22 operable for communicating a combustion gas. The gas stream vortex mixing system 10 includes at least one wing 450 disposed within the interior passageway of the duct 12. The wing 450 is operable for generating at least one vortex 452. The gas stream vortex mixing system 10 further includes at least one nozzle 40 disposed within the interior passageway 40 of the duct 12. The nozzle 40 is operable to discharge the ammonia mixture 50 into the interior passageway 50 of the duct 12.

The method includes providing a supply of combustion gas 14 into the interior passageway 14 of the duct 12 such that the combustion gas 14 passes about at least one of the wings 450. The method further includes discharging the ammonia mixture 50 from at least one nozzle 40 into the vortex 452 such that the ammonia mixture 50 is homogenized with the combustion gas 14 within the vortex 452.

Thus, it is apparent that there has been provided, in accordance with the present invention, a gas stream vortex mixing system 10 that satisfies one or more of the advantages set forth above. Although the preferred embodiment has been described in detail, it should be understood that various changes, substitutions, and alterations can be made herein without departing from the scope of the present invention, even if all of the advantages identified above are not present. For example, the various embodiments shown in the drawings herein illustrate that the present invention may be implemented and embodied in a variety of different ways that still fall within the scope of the present invention.

Also, the techniques, designs, elements, and methods described and illustrated in the preferred embodiment as discrete or separate may be combined or integrated with other techniques, designs, elements, or methods without departing from the scope of the present invention. Other examples of changes, substitutions, and alterations are readily ascertainable by one skilled in the art and could be made without departing from the spirit and scope of the present invention.

What is claimed is:

1. A gas stream vortex mixing system for mixing a gas stream, the gas stream vortex mixing system comprising:

a duct provided with an inner surface defining a passageway for communicating a gas stream;

a wing having a first end, a second end, a upper surface, and a lower surface, wherein the wing is non-movably coupled within the passageway of the duct and configured to shed a vortex in the gas stream at an edge of the second end of the wing, the fist end and second end extend into the passageway, the first end positioned upstream of a direction of travel of the gas stream, and the second end positioned downstream of the direction of travel of the gas stream; and a nozzle to discharge a mixture into the gas stream, the nozzle located adjacent the edge of the second end of the wing such that the nozzle discharges the mixture into the vortex in the gas stream at a point wherein the vortex is shed, wherein the nozzle is positioned to discharge the mixture in the direction of travel of the gas stream through the passageway of the duct to promote mixing of the mixture with the gas stream.

* * * * *

UNITED STATES PATENT AND TRADEMARK OFFICE

CERTIFICATE OF CORRECTION

PATENT NO. : 6,886,973 B2
DATED : May 3, 2005
INVENTOR(S) : Phillips

It is certified that error appears in the above-identified patent and that said Letters Patent is hereby corrected as shown below:

Column 10,
Line 1, please delete “fist” and insert -- first --.

Signed and Sealed this

Thirtieth Day of August, 2005

JON W. DUDAS
*Director of the United States Patent and Trademark Office*